US006434829B1

(12) United States Patent
Chen

(10) Patent No.: US 6,434,829 B1
(45) Date of Patent: Aug. 20, 2002

(54) KNIFE HAVING A WARNING STRUCTURE

(76) Inventor: Shou Mao Chen, 344, Sec. 1, Chung Shan Road, Tah-Cha Township, Taichung Hsien (TW)

( * ) Notice: Subject to any disclaimer, the term of this patent is extended or adjusted under 35 U.S.C. 154(b) by 0 days.

(21) Appl. No.: 09/870,554

(22) Filed: Jun. 1, 2001

(51) Int. Cl.[7] ..... B26B 1/10
(52) U.S. Cl. ..... 30/123; 30/151; 362/119
(58) Field of Search ..... 30/123, 125, 537, 30/535, 151, 152; 362/119, 120; 7/119, 167, 168, 158

(56) References Cited

U.S. PATENT DOCUMENTS 5,402,575 A * 4/1995 Maxcy ..... 30/123
5,653,525 A * 8/1997 Park ..... 362/119
5,727,319 A * 3/1998 Myerchin et al. ..... 30/123
5,857,268 A * 1/1999 Park ..... 362/119 X
6,027,224 A * 2/2000 Schnell ..... 362/119

* cited by examiner

*Primary Examiner*—Douglas D. Watts
(74) *Attorney, Agent, or Firm*—Harrison & Egbert

(57) ABSTRACT

A knife includes a handle, a blade, and a light-emitting member disposed in the interior of the handle such that the light-emitting member emits light at the time when the blade is folded out of the handle, and such that the light-emitting member stops emitting light at the time when the blade is folded into the handle.

1 Claim, 4 Drawing Sheets

KNIFE HAVING A WARNING STRUCTURE

BACKGROUND OF THE INVENTION

1. Field of the Invention

The present invention relates generally to a knife, and more particularly to a knife having a warning structure to prevent people from being injured by the knife.

2. Description of Related Art

The conventional pocket knife comprises a handle and a blade which is extractable from the handle and which is also retractable into the handle. When the blade of the pocket knife is extracted, the pocket knife is apt to inflict a bodily wound on a person, especially when the pocket knife is left on a table in a poorly-lit place. The conventional pocket knife is not provided with a means to alert the people that the blade of the pocket knife is extracted from the handle, and that the pocket knife must be handle with care.

BRIEF SUMMARY OF THE INVENTION

The primary objective of the present invention is to provide a knife, with a warning structure capable of emitting light at such time when the blade of the knife is folded out of the handle of the knife, thereby preventing people from being injured by the blade of the knife.

The features and the functions of the present invention will be more readily understood upon a thoughtful deliberation of the following detailed description of a preferred embodiment of the present invention with reference to the accompanying drawings.

DETAILED DESCRIPTION OF THE INVENTION

Figure 1:
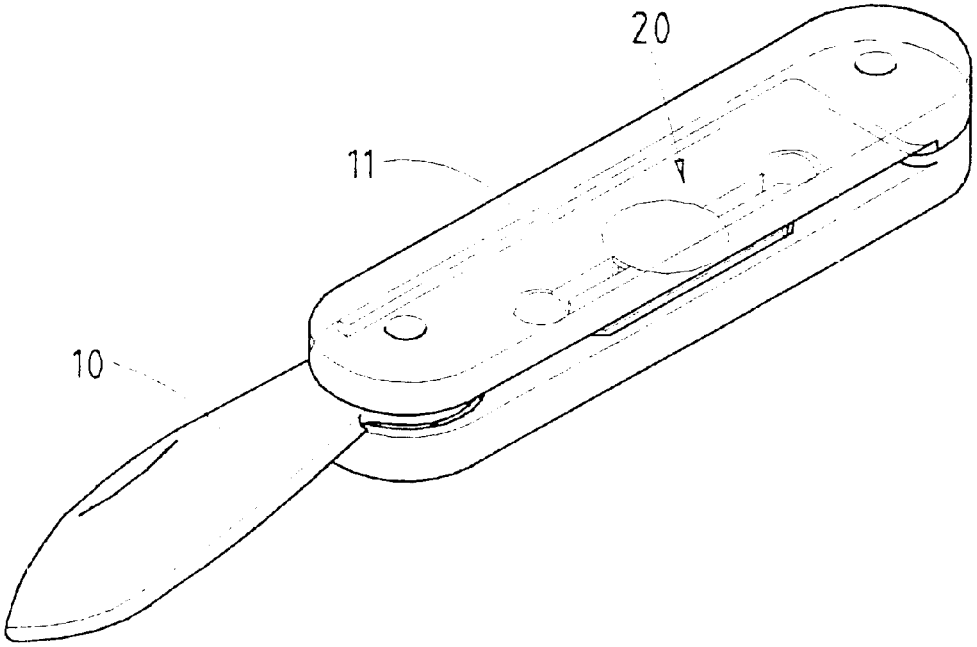
FIG. 1 shows a perspective view of the preferred embodiment of the present invention.
Figure 2:
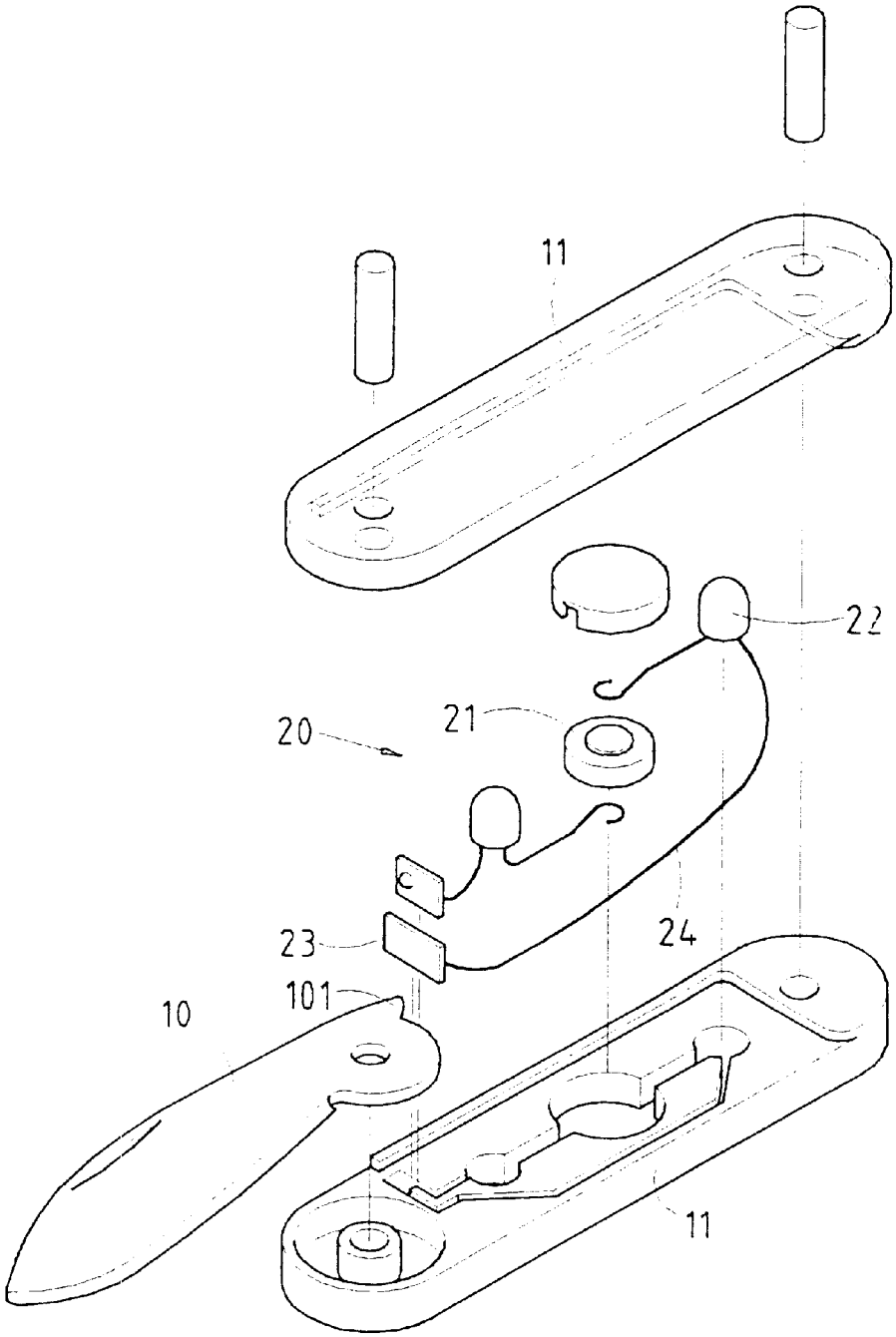
FIG. 2 shows an exploded view of the preferred embodiment of the present invention.
Figure 3:
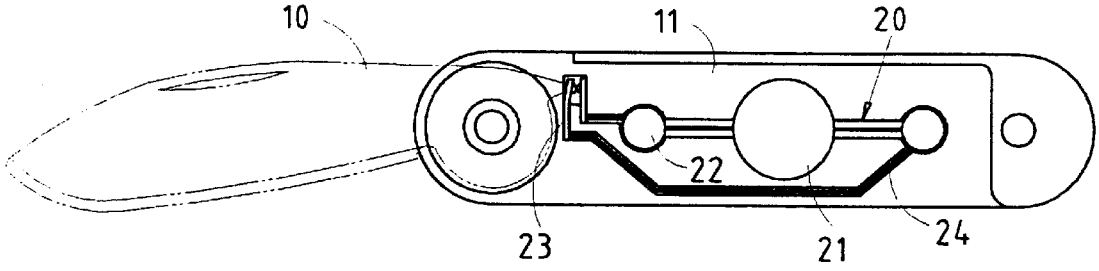
FIG. 3 shows a schematic view of the preferred embodiment of the present invention in use.
Figure 4:
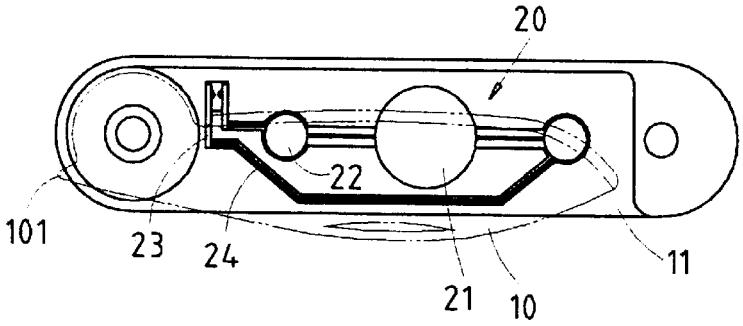
FIG. 4 shows another schematic view of the preferred embodiment of the present invention in use.
Figure 5:
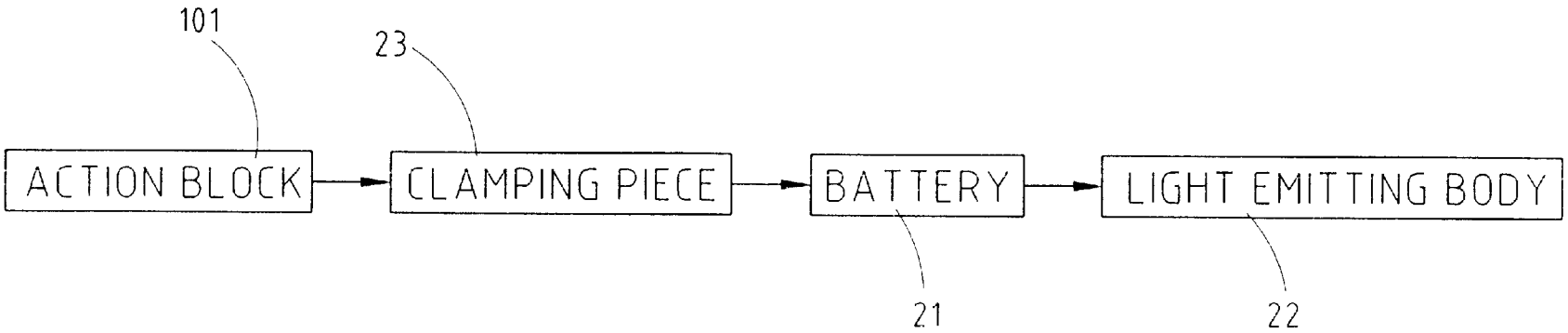
FIG. 5 shows a process flow of a light-emitting member of the preferred embodiment of the present invention.

As shown in FIGS. 1–5, a knife embodied in the present invention comprises a blade 10 and a handle 11. The blade 10 is pivoted at one end with the handle 11 such that the blade 10 can be folded into and out of the handle 11.

The knife of the present invention is characterized by the handle 11 and the blade 10, which are provided with a warning structure comprising an action block 101 which is an integral part of the blade 10, and a light-emitting member 20 which is disposed in the interior of the handle 11. The action block 101 turns along with the blade 10 to come in contact with the light-emitting member 20. The handle 11 of the present invention is made of a material pervious to light.

The light-emitting member 20 is formed of a battery 21, a light-emitting body 22, two camping pieces 23, and a circuit 24 which is connected with the battery 21, the light-emitting body 22, and the clamping pieces 23. The two clamping pieces 23 are separated from each other by an appropriate distance. When the blade 10 is folded into the handle 11, the light-emitting member 20 remains in the state of disconnection. As a result, no light is emitted by the light-emitting body 22. When the blade 10 is folded out of the handle 11, the action block 101 of the blade 10 is turned to press against the two clamping pieces 23, which are forced to come in contact with each other, thereby resulting in a complete connection of the light-emitting member 20. As a result, the current flows to the light-emitting body 22, which is thus able to emit light serving as a warning signal as of the exposed blade 10. When the exposed blade 10 is folded into the handle 11, the action block 101 turns away from the clamping pieces 23, which are once again separated from each other. As a result, the light-emitting member 20 is once again in the state of disconnection. The light-emitting body 22 is thus deprived of the current.

The embodiment of the present invention described above is to be regarded in all respects as being merely illustrative and not restrictive. According, the present invention may be embodied in other specific forms without deviating from the spirit thereof. The present invention is therefore to be limited only by the scope of the following appended claim.

I claim:

1. A knife comprising:

a handle made of a material previous to light;

a blade pivoted at one end with said handle such that said blade can be folded into and out of said handle whereby said one end of said blade further comprises an action block which turns along with said blade; and a light-emitting member comprised of a battery, a light-emitting body, two clamping pieces separated from each other by a distance, and a circuit in communication with said battery, said light-emitting body, and said two clamping pieces, said light-emitting member being disposed in an interior of said handle such that said two clamping pieces are pressed against by said action block of said blade to come in contact with each other at such time when said blade is folded out of said handle, thereby resulting in emission of light by said light-emitting body whereby said action block of said blade turns away from said two clamping pieces to result in separation of said two clamping pieces at such time when said blade is folded into said handle.

* * * * *